US005383763A

United States Patent [19]

Henkelmann

[11] Patent Number: 5,383,763

[45] Date of Patent: Jan. 24, 1995

[54] STEAM TURBINE WITH A ROTARY SLIDE FOR CONTROLLING STEAM THROUGHPUT

[75] Inventor: Dieter Henkelmann, Nürnberg, Germany

[73] Assignee: ABB Patent GmbH, Mannheim, Germany

[21] Appl. No.: 59,438

[22] Filed: May 4, 1993

[30] Foreign Application Priority Data

May 4, 1992 [DE] Germany ..... 4214773

[51] Int. Cl.[6] ..... F04D 5/48; F01D 17/12

[52] U.S. Cl. ..... 415/159; 415/148; 415/150; 137/625.31

[58] Field of Search ..... 415/148, 149.1, 149.2, 415/150, 151, 154.1, 154.2, 155, 158, 36, 38, 41, 44, 159; 60/662; 251/129.11, 212; 137/625.31, 625.3

[56] References Cited

U.S. PATENT DOCUMENTS

| | | | |
|---|---|---|---|
| 707,727 | 8/1902 | Schulz | 415/149.1 |
| 793,540 | 6/1905 | Purvis | 415/44 |
| 1,291,322 | 1/1919 | Wiberg | 415/159 |
| 1,544,285 | 6/1925 | Trotter | 415/159 |
| 1,894,117 | 1/1933 | Pollard et al. . | |
| 2,184,661 | 12/1939 | Bentley | 415/159 |
| 2,186,952 | 1/1940 | Bloomberg | 415/185 |
| 3,209,537 | 10/1965 | Mock . | |
| 3,589,829 | 6/1971 | Schetinin | 415/159 |
| 3,669,562 | 6/1972 | McNally et al. | 415/159 |

FOREIGN PATENT DOCUMENTS

| | | | |
|---|---|---|---|
| 0508067 | 10/1992 | European Pat. Off. . | |
| 165704 | 12/1981 | Japan | 415/148 |
| 56-165704 | 12/1981 | Japan . | |
| 7707 | 1/1984 | Japan | 415/148 |
| 487334 | 4/1970 | Switzerland . | |

OTHER PUBLICATIONS

"Zur Entwichlung von Niederdruck-Dampsteuer-organen derzeitiger Stand und Zullünttige Möglichkeiten", Berlin 1989 p. 77TT.

"Der Drehschieber als Regelorgan für Entnahme-Dampfturbinen" Berlin, Maschinenbautechnik, 1966, pp. 185H.

*Primary Examiner*—John T. Kwon

*Attorney, Agent, or Firm*—Herbert L. Lerner; Laurence A. Greenberg

[57] ABSTRACT

A steam turbine includes a rotary slide for controlling steam throughput, particularly in combination with a steam offtake. The rotary slide has control slits formed therein for that purpose. A stationary channel body has channel inlets formed therein. The control slits and the channel inlets cooperate with each other for increasingly opening and closing the channel inlets depending on a direction of rotation of the rotary slide at the time. The channel body has at least an adapter part in which the channel inlets are formed and a basic part having steam channels formed therein being required for conducting steam and in particular leading to nozzles. The channel inlets connect the control slits with the steam channels and are defined in accordance with an intended control characteristic.

18 Claims, 4 Drawing Sheets

STEAM TURBINE WITH A ROTARY SLIDE FOR CONTROLLING STEAM THROUGHPUT

The invention relates to a steam turbine having a rotary slide for controlling steam throughput, particularly in combination with a steam offtake, control slits formed in the control slide for that purpose and channel inlets formed in a stationary channel body, wherein the inlets cooperate in such a way that the channel inlets are increasingly opened or closed in accordance with the direction of rotation of the rotary slide at the time.

In steam turbine engineering, valves are virtually exclusively used to control the steam, while slides are only relatively seldom used as control devices. One reason for that is surely that valves are highly reliable and have an exact operative mechanism, and another is the problems that must be solved if slides are to be used in a practical way. For instance, the static relief that is virtually taken for granted in modern valves is not readily possible with slides. Moreover, it is disadvantageous in principle that unlubricated, hot parts which might become deformed will slide on one another.

Nevertheless, a number of attempts have been made to use rotary slides, at least where the use of control valves in steam turbines with an axial flow through them necessitates not only quite complicated constructions but also quite disadvantageous flow conditions. That is particularly true for pass-out steam turbines, in which the use of a rotary slide with an axial flow through it can lead not only to advantageous flow conditions but also to a space-saving structure.

In order to control the steam throughput in steam turbines, throttle regulation or nozzle group regulation is used. The latter is especially suitable for systems in which high partial-load efficiencies are to be attained. In them, the regulating stage has a plurality of nozzle groups, and the inflow of steam to each of the nozzle groups is adjusted with a separate regulating valve. As the capacity requirement increases, it is usual to act upon one nozzle group after the other with steam, which is done with the aid of suitably controlled regulating valves or by means of the control slits of a rotary slide. For a given load state, a more-or-less large number of nozzle groups is generally fully acted upon, so that as a result no throttling takes place and the various nozzles operate at an advantageous efficiency. Only one nozzle group, in accordance with the particular position of the regulating valve or rotary slide, will undergo merely a partial impingement, and as a result will operate at lesser efficiency. However, that loss will become less as the number of nozzle groups increases, so that it is logical to conclude that as many nozzle groups as possible should be provided, and in the ideal case each individual nozzle would be triggerable. That kind of multiplication of the regulating valves would rapidly run up again engineering limits, while a corresponding embodiment of a rotary slide would be more in the range of feasibility.

Rotary slide controls are known from an article entitled "Zur Entwicklung von Niederdruck-Dampfsteuerorganen, derzeitiger Stand und zukünftige Möglichkeiten" (Development of Low-pressure Steam Control Devices: Present Status and Future Possibilities), in a periodical entitled "Maschinenbautechnik" (Mechanical Engineering), Berlin, 38 (1989), pages 17 ff. That article already contains some suggestion that rotary slides can be made for both throttle regulation and nozzle group regulation. A first variant constructed as a radial slide is described, in which a large number of blockable individual windows lead into a channel body having an annular chamber located in front of a guide grid. In a second variant, which is constructed as an axial rotary slide, a large number of blockable individual windows are also provided, which lead directly to the guide blading through a channel body. However, both versions are suitable only for throttle regulation, in which the rotary slides must be displaced from the fully opened state to the fully blocking position, in each case by only a single window spacing.

Another article entitled "Der Drehschieber als Regelorgan für Entnahme-Dampfturbinen" (The Rotary Slide as a Regulating Device for Pass-Out Steam Turbines), in the periodical Maschinenbautechnik (Mechanical Engineering), Berlin, 15 (1966), pages 185 ff, states that it is possible in nozzle group regulation to stagger the cross sections of the individual groups somewhat relative to one another. However, with a rotary slide constructed in that way, even despite a disadvantageous reduction in cross section, no more than four nozzle groups can be provided. However, so few nozzle groups could be controlled with regulating valves as well, that such a suggestion achieves no improvement in the partial-load-range efficiency of the steam turbine.

It is accordingly an object of the invention to provide a steam turbine with a rotary slide for controlling steam throughout, which overcomes the hereinafore-mentioned disadvantages of the heretofore-known devices of this general type and which does so in such a way that the channel body cooperating with the rotary slide can be produced simply and can be adapted easily to different regulating tasks.

With the foregoing and other objects in view there is provided, in accordance with the invention, a steam turbine, comprising a rotary slide for controlling steam throughput, particularly in combination with a steam offtake, the rotary slide having control slits formed therein; a stationary channel body having channel inlets formed therein; the control slits and the channel inlets cooperating with each other for increasingly opening and closing the channel inlets depending on a direction of rotation of the rotary slide at the time; the channel body having at least an adapter part in which the channel inlets are formed and a basic part having steam channels formed therein being required for conducting steam and in particular leading to nozzles; and the channel inlets connecting the control slits with the steam channels and being defined in accordance with an intended control characteristic.

A substantial simplification in manufacture is brought about by splitting the channel body into a basic part and an adapter part. This makes it possible to produce a basic part that is identical for all applications, for instance in the form of a cast part, and to produce different channel bodies by means of a variable adapter part which is adapted for various applications. The adapter part is constructed as a ring, which is relatively easy to manufacture and which connects the channels of the basic part, that widen into nozzle chambers, with the control slits of the rotary slide, through the channel inlets formed in the basic part, assuming that the control slits are in a suitable position. The position and size of the various channel inlets may be adapted to a desired control characteristic in such a way that by means of them, a plurality of nozzles can be combined into a nozzle group, or only quite specific nozzles or nozzle groups may be triggered. This can be achieved because of their cooperation with the control slits provided in the rotary slide.

In accordance with another feature of the invention, the control slits cover a rotary angle that is at least as large as the channel inlets corresponding to them, and a rotary angle that is approximately equivalent to the rotary angle that the channel inlets cover on one orbit is located between the closure and the opening of all of the channel inlets. The amount of this latter rotary angle can be increased or decreased, depending on how large the number of orbits occupied by control slits and channel inlets is. The configuration enables the simultaneous opening of a plurality of nozzles that are spaced apart uniformly from one another over a rotary angle of 360°. In other words, nozzle group formation takes place in this case, but not in the usual way where a plurality of nozzles that are located next to one another are combined into a group. Instead, a plurality of nozzles which are distributed uniformly over the entire circumference are combined. This assures very uniform heating of a turbine housing and all of the other parts being acted upon by steam. However, a disadvantage of it is that with an increasing number of orbits to be provided with control slits, the configuration becomes more complicated, and with an increasing number of nozzle groups being formed, the control characteristic becomes correspondingly less finely graduated.

In accordance with a further feature of the invention, the rotary angle between the opening and the closure of all of the channel inlets is approximately equivalent to the sum of all of the rotary angles that are covered by all of the channel inlets disposed on their various orbits. In this case the channel inlets are offset from one another on their orbit, as compared with the control slits corresponding to them, in such a way that after the complete opening of all of the channel inlets of a first orbit, those of a second and ensuing optionally further orbits, are opened. This assures a very finely graduated control characteristic, because only one nozzle or nozzle group is ever opened at a time, in succession. One disadvantage of this configuration is that there is a loss in cross section, because with only one rotary slide, it is not possible to open successive nozzles over a rotary angle of 360°. However, the rotary angle that cannot be used for the nozzle regulation could be made usable by providing a bypass finally after the opening of all of the nozzles, and this bypass could then be opened by means of a suitably offset control slit.

In accordance with an added feature of the invention, the rotary slide is a double slide with two partial slides that cover one another and are each provided with control slits, and beginning at a closing position, a first partial slide driven for a rotational movement rotates relative to a second partial slide that is not driven, over a predetermined first rotary angle. At the end of this rotary angle, this first partial slide must engage the second partial slide and carry it with it over a predetermined second rotary angle. The control slits of the first partial slide and the control slits of the second partial slide are then disposed relative to one another in such a way, and correspond with the channel inlets in such a way, that upon a rotary motion of the first partial slide, one channel inlet after the other is opened. The closure of the channel inlets takes place in reverse order. With this configuration, all of the nozzles or nozzle groups which are provided can thus be triggered individually in succession, so that an especially finely graduated control characteristic is attained.

In accordance with an additional feature of the invention, the adapter part, which is relatively simple to manufacture, must be adapted to the structural conditions of its surroundings. For instance, it must be anchored as exactly as possible, and with good sealing, to the basic part. In accordance with yet another feature of the invention, it may optionally extend as far as the region of roller bearing races provided for the rotary slide, in which case it is practical for it to be hardened, at least in the region of receptacles intended for the roller bearing races.

In accordance with yet a further feature of the invention, in order to enable installation, all of the parts mentioned, such as the adapter part, the basic part and the rotary slide, above the shaft of the turbine, must be radially split into two halves, and then joined together again at the end. This can be done with the aid of parting line flanges.

In accordance with a concomitant feature of the invention, all of the characteristics described above may be employed with either an axial or a radial rotary slide and the channel body need merely be adapted accordingly. The advantage of the radial rotary slide is that it is statically relieved in the case of steam impingement which takes place uniformly over its entire circumference, so that wear remains within limits even in the case of a slide bearing. However, it has the disadvantage of steam deflection that is necessary in a turbine with an axial flow passing through it. In this respect, the axial rotary slide would be preferred, although it can be statically relieved only by means of relatively complicated structural forms, and the bearings must absorb the entire differential pressure as a rule.

Other features which are considered as characteristic for the invention are set forth in the appended claims.

Although the invention is illustrated and described herein as embodied in a steam turbine with a rotary slide for controlling steam throughout, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1:
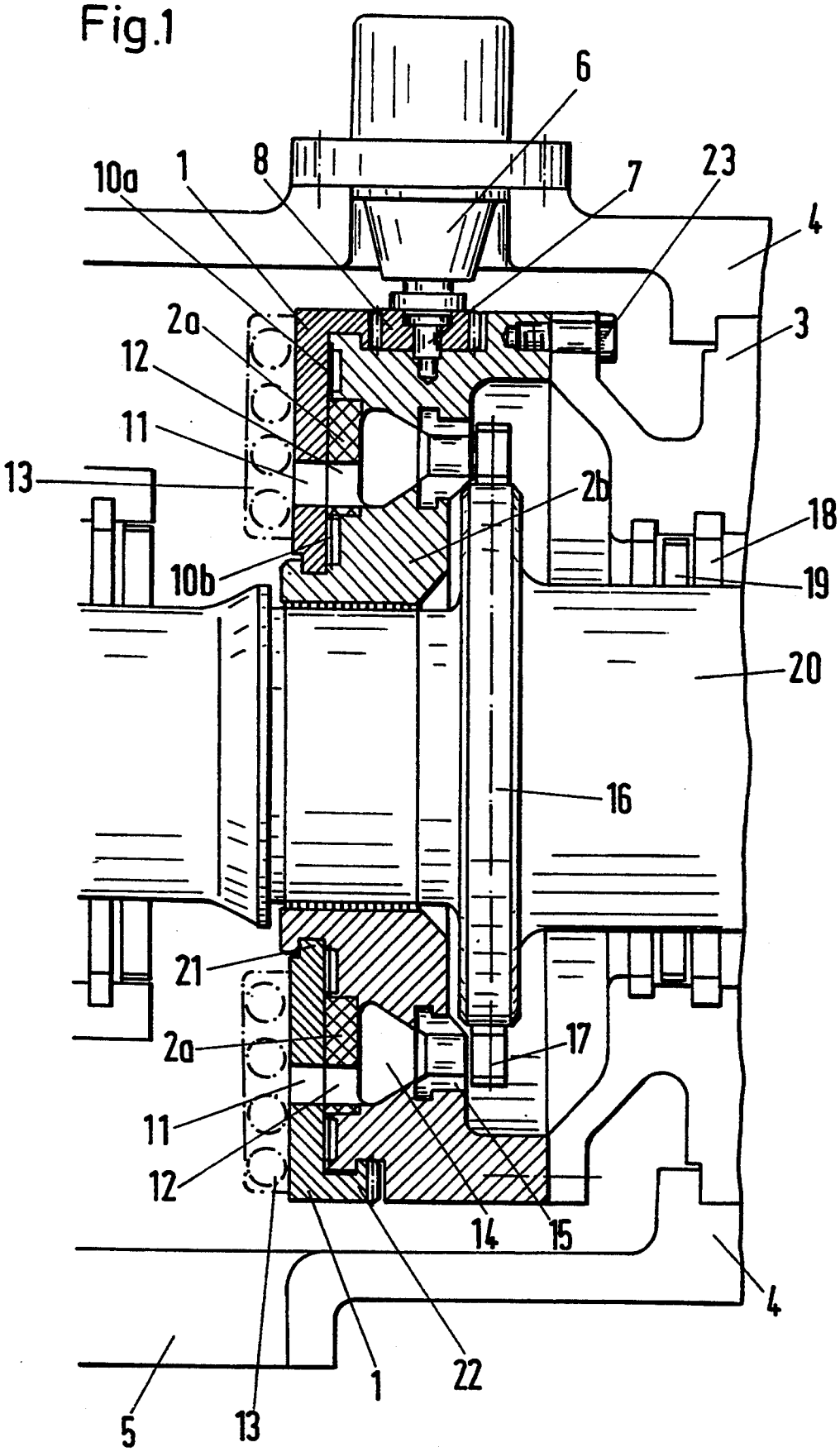
FIG. 1 is a fragmentary, diagrammatic, axial-sectional view of a steam turbine regulating stage with an axial rotary slide for nozzle group regulation, as seen in an open state, which is taken along a line B—B of FIG. 2 in the direction of the arrows.
Figure 2:
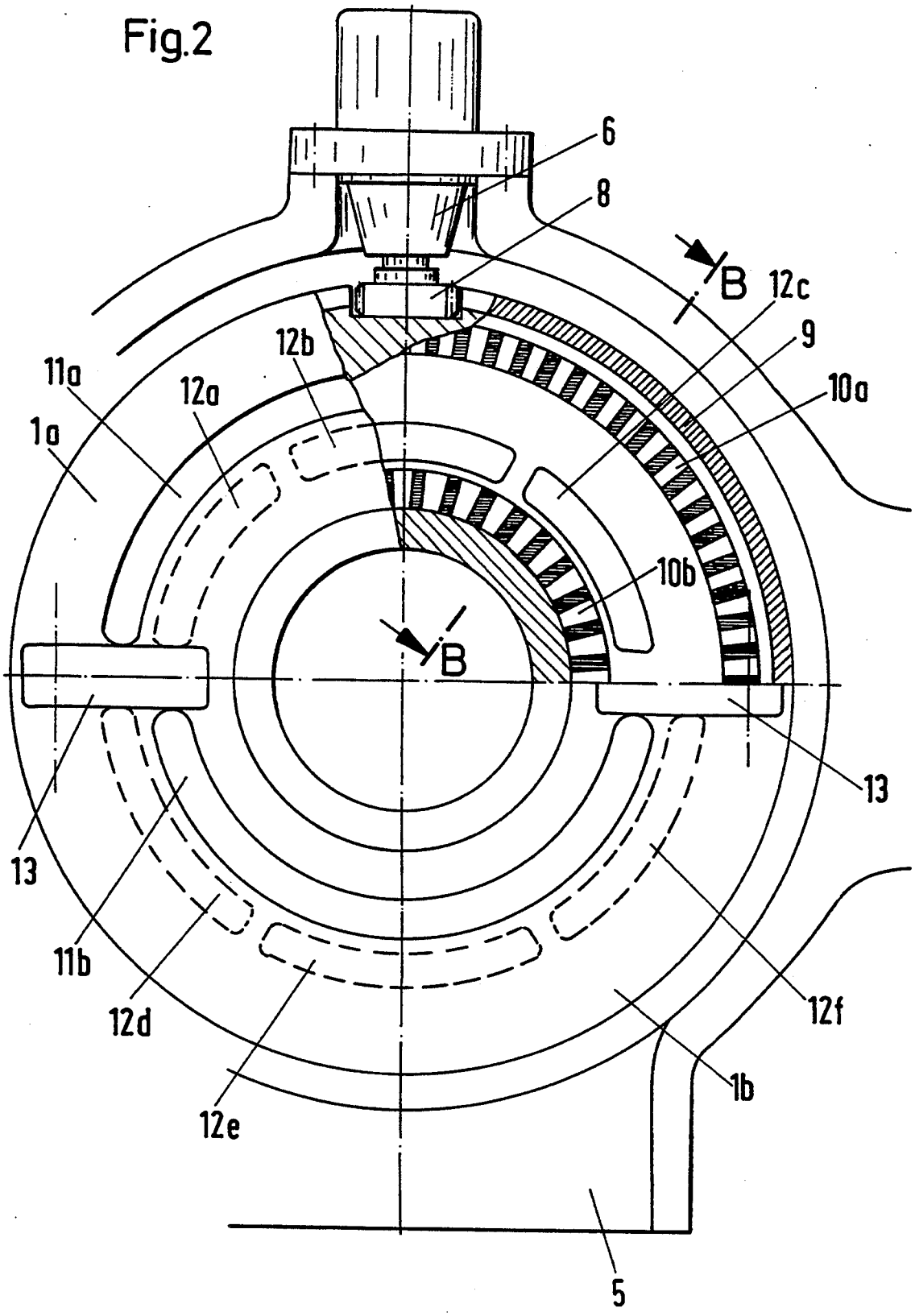
FIG. 2 is a fragmentary, axial view of a regulating stage as seen by looking toward the axial rotary slide in a closed state, which is partly broken-away and sectional to make channel inlets visible.

Referring now to the figures of the drawing in detail and first, particularly, to FIGS. 1 and 2 thereof, there is seen a regulating stage of a steam turbine which is located at an interface between two turbine parts of different pressure. In this case, a pass-out steam turbine is involved, in which an offtake is effected upstream of the regulating stage through an offtake channel 5. In order to regulate steam throughput, a rotary slide 1 which is constructed as a radial rotary slide is provided and is rotatably supported on a channel body 2*a*, 2*b* that in turn is flanged in a fixed fashion to a guide blade support 3. The entire configuration is enclosed by a turbine housing 4.

Steam arriving from the low-pressure part of the steam turbine flows through the rotary slide 1 in the region of a control slit 11 and through a channel inlet 12 of the channel body 2*a*, 2*b* to reach a nozzle chamber 14, and then flows to a nozzle 15. From there, it is carried to a regulating wheel 16 with regulating wheel blades 17 and finally to rotor blades 19 located between guide blades 18, so that it can drive a turbine rotor.

As FIG. 2 shows in particular, the special structure of both the rotary slide 1 and the channel body 2*a*, 2*b* enables very finely graduated nozzle group regulation. For that purpose, the rotary slide 1 has two control slits 11*a*, 11*b* which are offset by 180° from one another, on adjacent orbits or circular paths having smaller radii than the circumference of the rotary slide. These slits correspond with the channel inlets 12 of the channel body 2*a*, 2*b*. Three channel inlets 12*a*, 12*b*, 12*c* are located on a corresponding orbit having the same radius as that of the control sit 11b but being offset from it by a rotary angle of 180°. Correspondingly, three further channel inlets 12*d*, 12*e*, 12*f* are located on one orbit having the same radius as that of the control slit 11*a* and are again offset by a rotary angle of 180°.

While FIG. 1 shows a position of the rotary slide in which the rotary slide has opened the channel inlets 12, the rotary slide 1 of FIG. 2 is in a position which is rotated by 180°. In this position, all of the channel inlets 12 are closed. However, if the rotary slide 1 were moved clockwise, then the control slit 11*a* would first meet the channel inlet 12*f*, and the control slit 11*b* would meet the channel inlet 12*a*. The nozzle groups that communicate with the channel inlets 12*a*, 12*f* would accordingly be the first to be acted upon by steam. With an increasing power requirement, the rotary slide could be opened increasingly, in the course of which the channel inlets 12*e*, 12*b* would be the next to be engaged by the control slits 11*a*, 11*b*. After a 180° movement of the rotary slide 1, all of the channel inlets 12 would be fully opened.

As can easily be seen, two diametrically opposed channel inlets are always simultaneously acted upon by steam. This brings about a correspondingly uniform heating of the turbine housing. Naturally, it is possible for the various channel inlets 12 to be assigned different rotary angle lengths. For instance, it would be conceivable for the first two channel inlets to be assigned to a nozzle group including two or three nozzles, and then to provide only one nozzle per channel inlet for further increasing the power, in order to achieve the finest possible graduation of regulation.

In order to enable easy rotary motion, two roller bearing races 10*a* and 10*b* are provided, which may be constructed as axial needle rings for an axial rotary slide or as radial needle rings for a radial rotary slide. The roller bearing races 10*a*, 10*b* are disposed in such a way that the control slits 11 on one hand and the channel inlets on the other hand come to rest between them, thereby providing the best possible support for the rotary slide. In the case of an axial rotary slide, the roller bearing race 10*b* is an inner roller bearing race located in the vicinity of the axis and the roller bearing race 10*a* is an outer roller bearing race located toward the outside, as will be required. A toothed ring 9 is disposed farther out than the outer roller bearing race 10*a* and is provided in the region of the outer edge of the axial rotary slide 1. This ring 9 is engaged by a drive pinion 8 which is connected through a flexible cardan shaft 7 to a servomotor 6, that enables the rotary motion of the rotary slide 1 and is secured to the turbine housing 4.

The channel body 2*a*, 2*b* includes an adapter part 2*a* and a basic part 2*b*. In order to ensure that the rotary slide 1 and the channel body 2*a*, 2*b* can be joined together by the adapter part 2*a* and the basic part 2*b* upon installation above a shaft 20 of the turbine, they are split horizontally into rotary slide halves 1*a*, 1*b* and channel body halves. Thus the roller bearing rings, which may also correspond to conventional versions available on the market, must also be horizontally split. Through the use of parting line flanges, such as the rotary slide parting line flange 13 shown herein, it is possible for the two halves of each set to be joined together.

FIG. 1 also shows how the rotary slide 1 is anchored to the channel body 2*a*, 2*b* with a cam or collar 22 on one hand and in an annular groove 21 of the channel body on the other hand. The channel body, in turn, is flanged with screws 23 to the guide blade support 3. The two roller bearing races 10*a*, 10*b* are largely sunk within the channel body 2*a*, 2*b*.

Splitting the channel body 2*a*, 2*b* into the basic part 2*b* and the adapter part 2*a* means that the adapter part, which has the channel inlets 12 formed therein, forms a connection between the control slits 11 of the rotary slide 1 and the channels of the basic part 2*b* that are expanded into nozzle chambers 14. The adapter part 2*a* must be introduced into and joined to the basic part 2*b* in a known manner, in such a way that no leakage occurs between the two parts. Moreover, the adapter part may be adapted to its structural surroundings, assuming that its structural form is appropriate for production purposes. Thus it may optionally extend as far as the region of the roller bearing races, in which case it would be appropriate to subject the adapter part 2*a* to a limited or complete hardening.

FIGS. 3–12 show purely diagrammatic views of certain configurations of control slits, which are disposed on a plurality of orbits and are merely indicated by dashes, as well as channel inlets corresponding to them. In the rotary slides 1 shown in FIGS. 3 and 4, the channel inlets are also shown, even through they are actually covered in a plan view of the rotary slide. In both cases, the closing position of the rotary slide 1 is shown.

Figure 3:
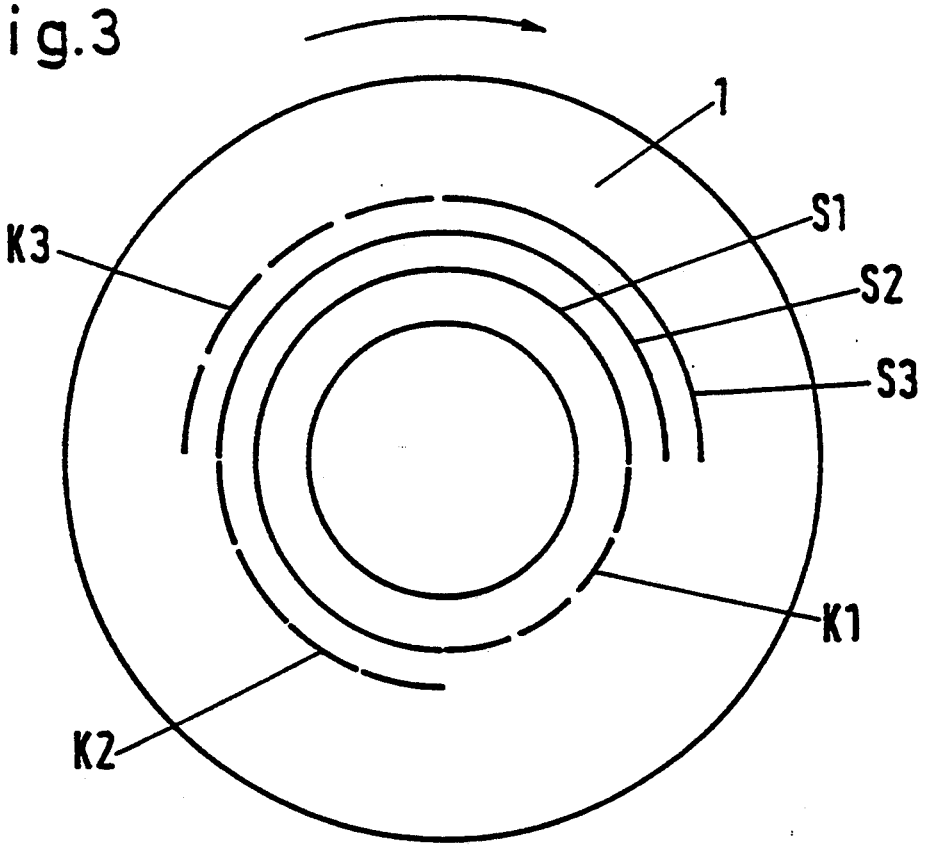
FIG. 3 is a plan view of a first variant of the rotary slide with a particular configuration of control slits with respect to the channel inlets.

If the rotary slide 1 in FIG. 3 is moved clockwise, then a first control slit S1, which extends over a rotary angle of 270°, will meet first channel inlets K1 and open them in succession. After a 90° rotation, a second control slit S2, which extends over a rotary angle of 180°, will also meet second channel inlets K2 and likewise open them in succession. Finally, a third control slit S3, which extends over a rotary angle of only 90°, opens third channel inlets K3. Upon complete opening of the rotary slide 1, the channel inlets K1, K2, K3, which together extend over an angle of 270°, are opened.

Figure 4:
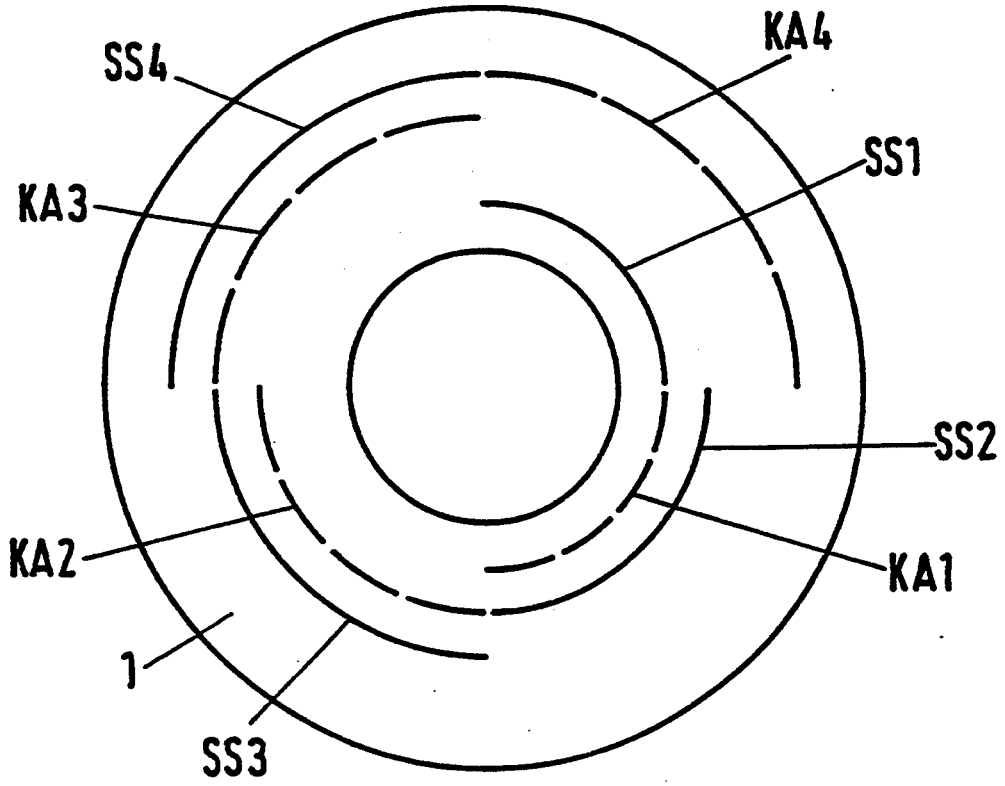
FIG. 4 is a plan view of a second variant of the rotary slide with a configuration of the control slits relative to the channel inlets that is different from FIG. 3.

If the rotary slide 1 of FIG. 4 is also rotated clockwise, then control slits which are located on four orbits next to one another, that is slits SS1–SS4, that are offset from one another by 90° and extend over a rotary angle of 90° each so that together they cover an angle of 360°, open a first channel inlet of channel inlets KA1–KA4. In other words, two times two opposed channel inlets are opened, which leads to an impingement upon four symmetrically disposed nozzles or nozzle groups.

Figure 5:
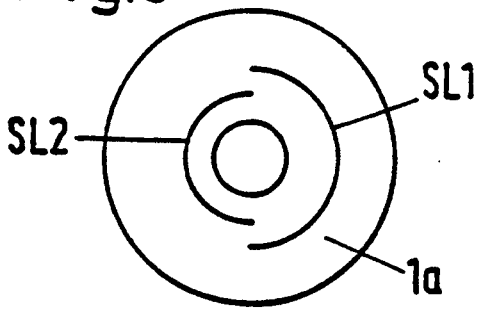
FIG. 5 is a plan view of a first partial slide of a rotary slide constructed as a double slide.
Figure 6:
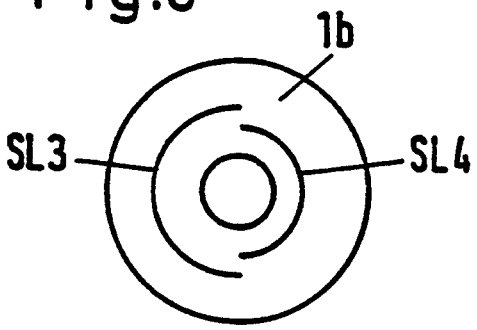
FIG. 6 is a plan view of a second partial slide of a rotary slide constructed as a double slide.
Figure 8:
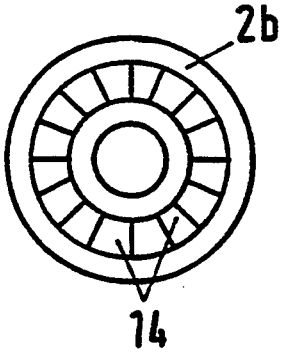
FIG. 8 is a plan view of a basic part having channels.

FIGS. 5 and 6 show two partial slides 1*a*, 1*b* of a rotary slide 1, that is constructed as a double slide, in the form of separate parts disposed side by side, in their closing position. The two partial slides 1*a*, 1*b* associated with the adapter part 2*a* shown in FIG. 7 and the basic part 2*b* shown in FIG. 8, are actually mounted one above the other, and are only shown side by side in order to illustrate their mutual positions. The channels or nozzle chambers 14 in the basic part 2*b* must cover all of the orbits on which first, second, third and fourth control slits SL1, SL2, SL3 and SL4 or first and second channel inlets KE1, KE2 are located, or in other words they must be appropriately wide. In FIGS. 9–12, the various opening positions of the rotary slide 1 are shown after a further clockwise rotation of 90° for opening the rotary slide.

Figure 9:
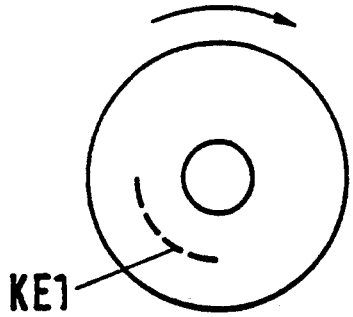
FIG. 9 is a plan view of opened channel inlets of the double rotary slides, after a 90° opening rotation.
Figure 10:
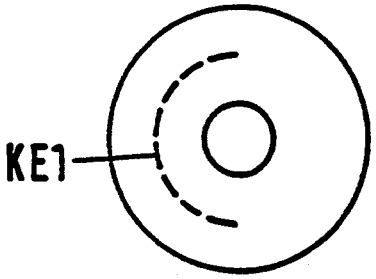
FIG. 10 is a plan view of the opened channel inlets after a 180° opening rotation of the double slide.
Figure 7:
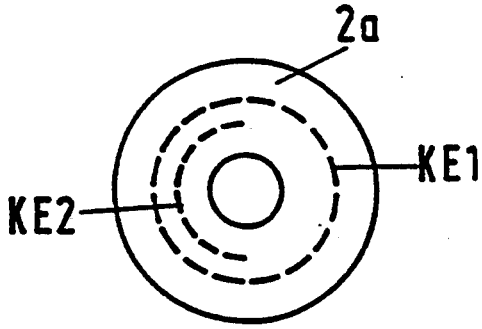
FIG. 7 is a plan view of an adapter part having the channel inlets.
Figure 11:
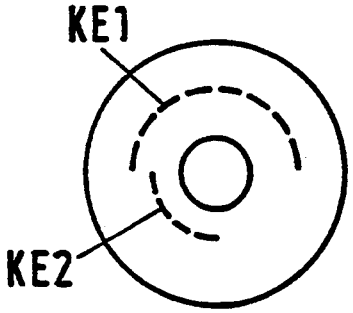
FIG. 11 is a plan view of the channel inlets after a 270° opening rotation of the double slide.
Figure 12:
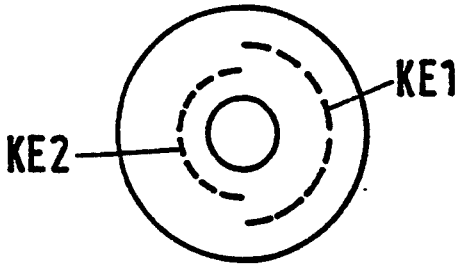
FIG. 12 is a plan view of the channel inlets after a 360° opening rotation of the double slide.

Through the use of a servomotor, the first partial slide 1*a* is driven clockwise, while the second partial slide 1*b* remains in its position. As a result, the first control slit SL1 first meets the third control slit SL3 of the second partial slide 1*b* and opens the channel inlets KE1 disposed beneath it, as is shown in FIG. 9 and 10. After a 180° rotation, all of the channel inlets KE1 located below the control slits SL3 are open. The two partial slides 1*a* and 1*b* are then connected to one another by a dog or driver which is constructed in a known manner and are rotated onward in common, with the control slits SL1 and SL2 being located above the control slits SL3 and SL4. The opening of the second channel inlets KE2 that then begins can be completed without further provisions, as is shown in FIGS. 11 and 12.

Through the use of the double slide, it is possible to individually trigger all of the nozzles or nozzle groups which are provided, in succession. The dog must be constructed in such a way that upon reverse rotation of the rotary slide 1 to the closing position, it releases the connection of the two partial slides 1*a*, 1*b* only after a rotary angle of 180°.

FIG. 1 also shows a way in which a bypass is constructed in the rotary slide. The channel body needs to enable a flow around the regulating wheel 16 only in the region of a bypass 24.

I claim:

1. A steam turbine, comprising:

a rotary slide for controlling steam throughput, said rotary slide having control slits formed therein;

a stationary channel body having channel inlets formed therein;

said control slits and said channel inlets cooperating with each other for increasingly opening and closing said channel inlets depending on a direction of rotation of said rotary slide at the time;

said channel body having at least a basic part having steam channels formed therein required for conducting steam and an adapter part in which said channel inlets are formed disposed between said rotary slide and said basic part; and said channel inlets connecting said control slits with said steam channels formed in said basic part and being defined in accordance with an intended control characteristic of said rotary slide.

2. The steam turbine according to claim 1, wherein said rotary slide controls steam throughput for withdrawing steam.

3. The steam turbine according to claim 1, including nozzles to which said steam channels lead.

4. The steam turbine according to claim 3, wherein said channel inlets have cross sections, fixed dimensions and positions for engaging at least one of said steam channels formed in said basic part with said cross section thereof and defining a number of said nozzles forming a nozzle group.

5. The steam turbine according to claim 3, wherein said channel inlets have cross sections, fixed dimensions and positions for engaging at least one of said steam channels formed in said basic part with said cross section thereof and defining a bypass and a number of said nozzles forming a nozzle group.

6. The steam turbine according to claim 3, wherein said channel inlets have cross sections, fixed dimensions and positions for engaging at least one of said steam channels formed in said basic part with said cross section thereof and defining a bypass.

7. The steam turbine according to claim 1, wherein said control slits cover a rotary angle being at least as large as said channel inlets corresponding to said control slits, closure and opening of all of said channel inlets define a rotary angle therebetween being approximately equivalent to a rotary angle that said channel inlets cover on an orbit, and said rotary angle is 360° divided by the number of said orbits.

8. The steam turbine according to claim 1, wherein opening and closure of all of said channel inlets define a rotary angle therebetween being approximately equivalent to a sum of all rotary angles being covered by all of said channel inlets disposed on respective orbits, said orbits includes first, second and ensuing further orbits, said channel inlets are offset from one another on said orbits with respect to said control slits corresponding to them, and said channel inlets of said second and ensuing further orbits are opened after a complete opening of all of said channel inlets of said first orbit.

9. The steam turbine according to claim 1, wherein said rotary slide is a double slide having a first driven partial slide and a second non-driven partial slide covering one another, each of said partial slides has control slits formed therein, and beginning at a closing position, said first partial slide is driven with a rotary motion and rotates relative to said second non-driven partial slide over a first predetermined rotary angle, and at an end of said rotary angle said first partial slide engages said second partial slide and carries said second partial slide with it over a second predetermined rotary angle, and said control slits of said first partial slide and said control slits of said second partial slide are disposed relative to one another and correspond to said channel inlets for opening one of said channel inlets after the other and closing said channel inlets in reverse order upon a rotary motion of said first partial slide.

10. The steam turbine according to claim 9, wherein said first predetermined rotary angle is approximately 180°, and said second predetermined rotary angle is approximately 180°.

11. The steam turbine according to claim 1, wherein said adapter part is anchored to said basic part in a leakage-proof manner.

12. The steam turbine according to claim 1, wherein said adapter part is tempered.

13. The steam turbine according to claim 1, wherein said adapter part is detonation-coated.

14. The steam turbine according to claim 1, including a roller bearing race disposed between said stationary channel body and said rotary slide outside the vicinity of said control slits and said channel inlets for reducing rotational friction, said roller bearing race having a running region, and said adapter part being tempered in said running region.

15. The steam turbine according to claim 1, including a roller bearing race disposed between said stationary channel body and said rotary slide outside the vicinity of said control slits and said channel inlets for reducing rotational friction, said roller bearing race having a running region, and said adapter part being detonation-coated in said running region.

16. The steam turbine according to claim 1, including a turbine shaft, said adapter part, said basic part and said rotary slide being split horizontally into two halves, being mounted above said turbine shaft and being joined to one another.

17. The steam turbine according to claim 1, wherein said rotary slide is an axial rotary slide, and said adapter part and said basic part of said channel body are adapted to said rotary slide.

18. The steam turbine according to claim 1, wherein said rotary slide is a radial rotary slide, and said adapter part and said basic part of said channel body are adapted to said rotary slide.

* * * * *